United States Patent [19]

Baumgartner

[11] Patent Number: 4,775,131

[45] Date of Patent: Oct. 4, 1988

[54] DEVICE FOR ASSEMBLY OF STAIR FORMS

[76] Inventor: David Baumgartner, 2224 Donovan Dr., Eugene, Oreg. 97401

[21] Appl. No.: 880,694

[22] Filed: Jun. 30, 1986

[51] Int. Cl.[4] ..... E04G 13/06

[52] U.S. Cl. ..... 249/208; 33/518; 33/562; 249/14; 249/53 R; 249/219.1

[58] Field of Search ..... 249/14, 2–8, 249/50, 53 R, 155, 159, 208, 219 R; 33/518, 562, 416, 417, 180

[56] References Cited

U.S. PATENT DOCUMENTS

| | | | |
|---|---|---|---|
| 1,106,627 | 8/1914 | Cornelius | 249/14 |
| 1,173,066 | 2/1916 | Vandegrift | 249/208 |
| 1,182,307 | 5/1916 | Park | 249/53 |
| 1,427,276 | 8/1922 | Feldblet et al. | 249/14 |
| 1,543,090 | 6/1925 | Baumann | 249/208 |
| 1,787,799 | 1/1931 | Soule et al. | 249/208 |
| 1,888,686 | 11/1932 | O'Donnell | 249/14 |
| 2,744,332 | 5/1956 | Day | 33/416 |
| 2,824,355 | 2/1958 | Griset | 249/208 |
| 2,827,682 | 3/1958 | Saylors | 249/208 |
| 3,331,579 | 7/1967 | Petersen | 249/14 |
| 3,612,472 | 10/1971 | Steigerwaldt, Jr. | 249/208 |
| 3,823,910 | 7/1974 | Crozier | 249/14 |

*Primary Examiner*—Jay H. Woo
*Assistant Examiner*—James C. Housel
*Attorney, Agent, or Firm*—Pretty, Schroeder, Brueggemann & Clark

[57] ABSTRACT

An apparatus as disclosed for making concrete forms for making stairs. A substantially planar member has a riser end and a pivot end substantially opposite the riser end and has first and second. A pivot point rotatably fixes the pivoting end to a stringer so that the riser end can pivot with respect to the pivot end. A riser support member is mounted perpendicular to the planar member adjacent the riser end and extends to each side of the planar member. A kneeboard support may be placed on both sides of the planar member so that a kneeboard may be placed between one apparatus and a corresponding apparatus on the other side of the stairs. A scale may be provided for positioning the apparatus with respect to the stringer to facilitate mounting subsequent apparatus to a given stringer. The riser support member may be slanted to provide a constant toe-in or kickback.

29 Claims, 3 Drawing Sheets

DEVICE FOR ASSEMBLY OF STAIR FORMS

BACKGROUND OF THE INVENTION

1. Field of the Invention

The present invention relates to construction forms and more specifically to a device for making concrete forms for making stairs.

2. Related Art

In the vast majority of construction projects, steps or stairs are made by first setting up a form including a 2×4 or 2×6 called a stringer on each side of the place where the stairs are to be poured and then by plumbing a line on each stringer corresponding to the riser of each step to be formed. If the riser of each step, i.e. the substantially vertical portion of each step, is to be exactly vertical, the rise form for each step is then nailed at each location on the respective stringers. Each plumbline is struck a predetermined distance from an adjacent plumbline according to the desired run, i.e. the substantially horizontal distance for each step. The run is basically the same as the tread of each step. This prior method was described in U.S. Pat. No. 3,331,579, to Peterson with respect FIG. 1. The description of the prior method of making riser supports is incorporated herein by reference.

The prior method of making forms for stairs required a preliminary layout on the stringers of the tread and risers and then fastening of the riser forms and support blocks for the riser forms. In order to trowel the poured concrete, the worker had to stand on the riser supports to gain access to each step. The form for the stairs could not be broken down until the steps had completely formed. This required substantial time and effort.

SUMMARY OF THE INVENTION

The apparatus or brace for making concrete forms for making stairs according to the present invention includes a substantially planar member having a riser end and a pivot end substantially opposite the riser end and having first and second sides. Means are provided for rotatably fixing the pivoting end to a stringer so that the riser end can pivot with respect to the pivot end. A riser support member is positioned perpendicular to the planar member adjacent the riser end and extends to each side of the planar member.

The apparatus is then used along with a plurality of other identical apparatus and a pair of stringers and riser forms to build the concrete form. Specifically, a first brace is rotabably fixed on the stringer. A framing square is placed adjacent the first brace and a second brace is positioned on the stringer using the framing square and spaced from the first brace to give a proper rise and run between the first brace and the second brace. The distance along a right angle defined by the framing square between the top of the riser support member on the first brace and the top of the riser support member on the second brace defines the run in a horizontal direction and the rise in a vertical direction. The second brace is moved along the stringer until the desired rise and run are set. The second brace is then pivotally fixed to the stringer and the first and second braces can be finally adjusted and then fixed relative to the stringer so that the first and second braces can no longer pivot. Assuming all the steps will have an identical rise and run, the distance between pivot points on adjacent braces is identical. Therefore, a third brace may be mounted to the stringer a like distance from the second. The third brace is then pivoted around the pivot point until the angle of the third brace relative to the stringer is identical to those of the first and second braces. Additional braces are added in an identical fashion.

The second stringer is set and assembled with a corresponding number of braces in an identical manner. The two stringers are then placed between opposing walls of the building or frame along which the stairs are to be formed. Riser forms are nailed to opposite riser support members on each corresponding brace. Concrete is then poured from the top of the form and allowed to run down to the bottom and fill in the space between the underlying floor or support and each riser form. The tread or run and riser are thereby formed. The worker can then trowel and otherwise finished the stairs as required.

The form may be broken down by removing each pair of braces and their corresponding riser form from the top of the stairs, and working down to the bottom. This can be done as soon as the cement of the stairs sets.

A kneeboard support may be placed on each side of the brace so that a kneeboard can extend from one brace to the opposite brace for each step. Using the kneeboard, the worker can step and kneel on the kneeboard while finishing the stairs and while breaking down the form. The riser support member and kneeboard support for each brace preferably extend outward from each side of the braces. The kneeboard support preferably extends a distance from each side of the planar member greater than the corresponding distance of the riser support member. This forms a ledge against which the horizontal part of the framing square can be placed for defining the position of the first two braces on the stringer.

The riser support member and the kneeboard support may be perpendicular to each other. However, if a constant toe-in or kickback for each stair is desired, the angle between the riser support member and the kneeboad support may be less than 90°.

A scale may be provided on all or part of the riser end of each brace to facilitate final positioning of each brace after the pivot point has been set. Once the first two braces are set, the scale may be used relative to a center line or edge of the stringer to find the final position of each brace. The use of a centerline is preferred because either of the stringers may not be straight.

DETAILED DESCRIPTION OF THE PREFERRED EMBODIMENT

Figure 1:
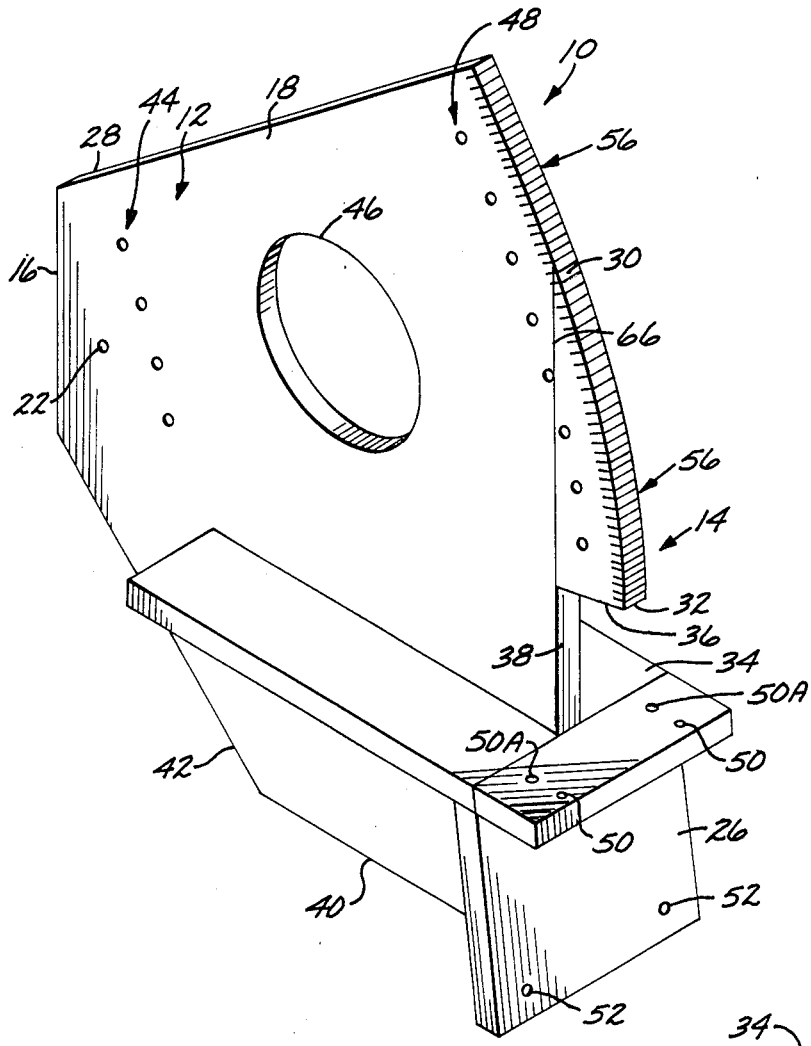
FIG. 1 is a perspective view of an apparatus in the form of a brace for making concrete forms for making stairs according to the present invention.
Figure 3:
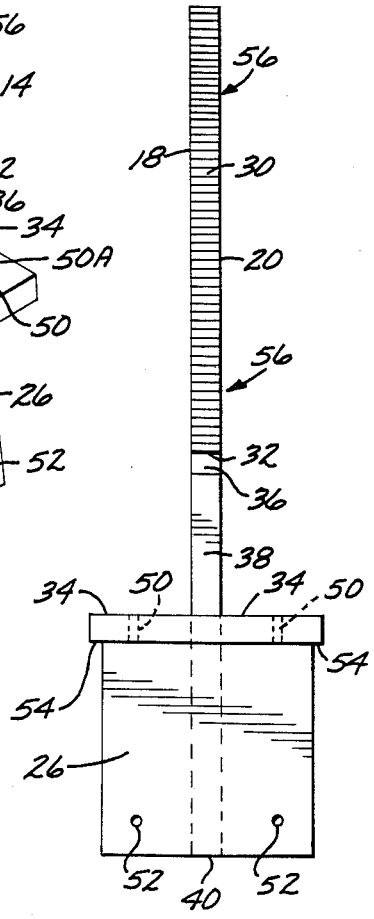
FIG. 3 is a front elevation view of the brace of FIG. 1.
Figure 2:
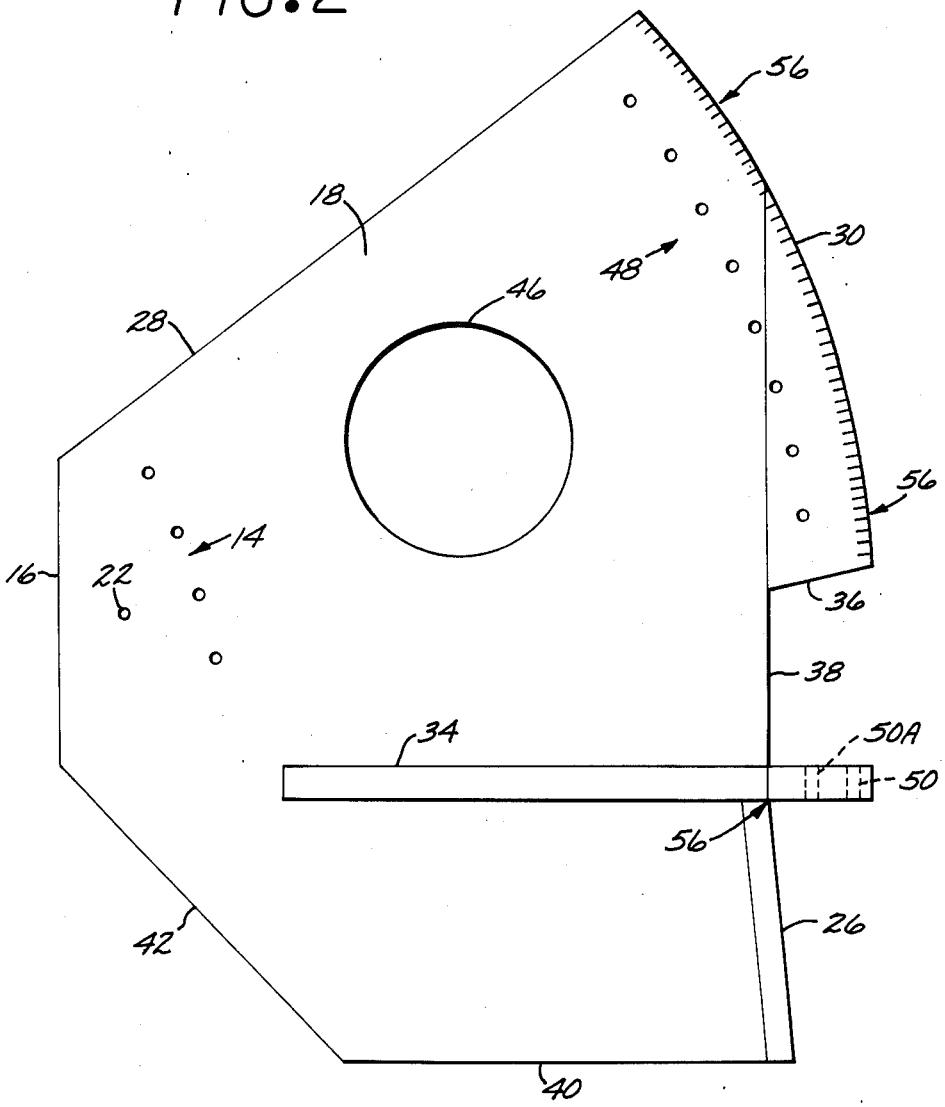
FIG. 2 is a side elevation view of the brace shown in FIG. 1.

FIGS. 1–3 show an apparatus in the form of a brace 10 for making concrete forms for making stairs. The brace is formed from a substantially planar member in the form of a brace plate 12 for mounting to a stringer and has a riser end 14 and a pivot end 16. The pivot end is substantially opposite the riser end. The brace plate has first and second sides 18 and 20, respectively. Means are provided in the form of a pivot point or pivot hole 22 in the pivot end 16 for rotatably fixing the pivot end to a stringer 24 (FIGS. 4 and 5) so that the riser end 14 can pivot with respect to the pivot end. Once the pivot end is fixed to the stringer through a nail or other fastening means passed through the pivot hole, the brace can pivot about the nail to adjust the rise and run as described below. A riser support member in the form of a riser support board 26 is mounted perpendicular to the brace plate adjacent the riser end 14 and includes first and second sides which extend outward or laterally from the respective first and second sides of the brace plate a given distance.

The brace plate 12 includes an upper side 28 extending from the top of the pivot end 16 upwardly and away from the riser support board to an arcuate side 30 in the riser end 14. The arcuate side extends downward in an arc defined by a radius (not shown) extending from an imaginary point behind the pivot end to the arcuate side and downward toward the riser support board. The arcuate side terminates in a lower end 32 of the arcuate side above a horizontal line or plane defined by the kneeboard support 34 as seen in FIG. 2, described more fully below.

The riser end then cuts along another radius rearward toward the pivot end forming a lower radial side 36 terminating at a vertical front side 38. The vertical front side extends downward along a plumbline formed or marked on each of the first and second sides to the kneeboard support 34 which is preferably horizontal when in the proper position on the stringer after the stringer is mounted to an appropriate frame. The kneeboard support is either glued, formed integral with or is otherwise fixedly mounted to the brace plate and extends outward from both the first and second sides of the brace plate. The kneeboard support is a flange member perpendicular to the brace plate and extends a substantial distance between a point forward of the pivot end and the frontmost portion of the riser end. In the preferred embodiment, the kneeboard support extends beyond the vertical front side 38. However, the kneeboard support does not extend behind the pivot point; the brace is therefore allowed to pivot around the pivot hole.

From the bottom of the kneeboard support, the vertical front side of the brace plate extends downwardly and away from the pivot side of the brace. The riser support board 26 is glued, made integral with or otherwise fixed to that portion of the vertical front side extending below the bottom of the kneeboard support. The riser support board extends downwardly at an angle of less than 90° from the front portion of the kneeboard. The brace plate terminates in a bottom side 40 extending substantially horizontally, as seen in FIGS. 1–3, to an angled backside 42 connecting the rearmost portion of the bottom edge to the bottom of the pivot end.

The brace plate includes a plurality of mounting holes 44 formed in the brace plate spaced a given distance from the pivot hole 22 and between the pivot hole and the arcuate side 30. The mounting holes 44 are positioned along an arc preferably having a radius of curvature the same as the radius of curvature of the arcuate side. The mounting holes serve to fix the brace on the stringer, to provide additional support for the riser form, described more fully below, and to provide support for the boards to be placed on the respective kneeboard support of the braces. The support function of the mounting holes is additional to the support function of the pivot hole 22.

A large hole 46 is formed approximately midway between the pivot point and the arcuate side to form a handle and to provide access to the stringer through the brace plate. The hole can also be used to locate a chalk line struck on the stringer prior to mounting each brace. A plurality of forward mounting holes 48 are formed in the brace plate adjacent the arcuate side 30. The mounting holes serve the same function and have the same radius of curvature as the mounting holes 44 adjacent the pivot hole. The pivot hole 22, the mounting holes 44 and 48 and the large hole 46 are formed completely through the brace plate 12.

The kneeboard support includes at least one pair of riser form mounting holes 50, one hole of each pair on each side of the brace plate and in front of the vertical front side 38. These holes are for nailing the riser form, described more fully below, to the brace 10 for supporting the riser form in a vertical plane. The nails keep the riser form from moving with respect to the support board 26 due to the weight of the cement. The riser support board also includes at least one pair of riser form mounting holes 52 for nailing the riser form to the brace. The pair of holes are formed in the riser support board on respective sides of the brace plate and near the bottom of the riser support board. In the preferred embodiment, each riser form mounting hole on the same side of the brace plate in the kneeboard and in the riser support form are formed equal distances from the respective side of the brace plate.

The kneeboard support also includes alignment holes 50A aligned with the bottom edge of the riser support board for setting the riser form for zero toe-in or kickback. The alignment hole 50A are placed between the mounting holes 50 and a transverse line 50B perpendicular to the plumbline 66, described more fully below. When nails are placed in the alignment holes 50A and a riser form placed against the nails and the lower portion of the support board 26, the riser form will be substantially vertical to give zero toe-in.

As seen most clearly in FIG. 3, the kneeboard support extends laterally a horizontal distance from a respective side of the brace plate greater than a corresponding distance for the riser support board 26. This provides a ledge 54 on each side of the kneeboard support extending beyond the respective side of the riser support board for accommodating a framing square, as described more fully below with respect to FIG. 4.

Scales 56 are provided in the arcuate side 30 by marking, scoring or otherwise for indicating spaced locations along the arcuate side. The scales are formed not only in the surface of the arcuate side 30 but also on the first and second sides of the brace plate a given distance from the arcuate side. These scales are used to pivotally position the brace with respect to a chalk line on the stringer to finally position the brace on the stringer. The final position of the brace will determine the correct rise and run of the steps. A sufficient number of scale marks are provided to allow pivotal movement of the brace to accommodate a rise of between 4 and 8 inches.

The preferred dimensions of the brace will now be described for a brace made from plywood. These preferred dimensions provide for forming stairs to meet most code requirements. These dimensions are preferred only and other appropriate dimensions can be used without detracting from the benefits of the invention. The length of the pivot end is $3\frac{1}{2}$ inches. The length of the upper side is $8\frac{1}{2}$ inches. The vertical distance between the top of the pivot end and the top of the arcuate side is $5\frac{1}{8}$ inches. The angle between the upper side and the horizontal is preferably $37\frac{1}{2}$ inches. This provides for a rise of 8 inches when the pivot point is placed as described.

The vertical distance between the bottom of the pivot end and the rearwardmost portion of the bottom edge 40 is $3\frac{3}{8}$ inches. The horizontal distance from the pivot end and the rearmost portion of the bottom side is also $3\frac{3}{8}$ inches. The length of the bottom side is $4\frac{7}{8}$ inches. The radius of curvature of the arcuate side 30 is 17 3/16 inches. Each of the mounting holes 44 is $\frac{3}{4}$ inch along an arc from each other and the mounting hole closest to the upper side is $\frac{3}{4}$ inch from the upper side. The mounting holes 44 are $\frac{3}{4}$ inch from a parallel arc through the intersection of the pivot end and the upper side. The mounting holes 48 are $\frac{3}{4}$ inch from the arcuate side 30. The pivot hole 22 is $\frac{3}{4}$ inch from the pivot end and is $1\frac{3}{4}$ inches from a line collinear with the top of the kneeboard support when viewing FIG. 3. Each of the pivot holes and the mounting holes are $\frac{1}{8}$ inch in diameter. The large hole is $2\frac{1}{2}$ inches in diameter, the center of which is $4\frac{3}{8}$ inches from the pivot hole and $2\frac{3}{4}$ inches from the upper side along a line perpendicular to a line between the center of the pivot hole and the center of the large hole. The linear distance between each graduation on the scales is $\frac{1}{4}$ inch. The height of the vertical front side from the top of the kneeboard support is approximately 2 inches. The thickness of the kneeboard support is $\frac{3}{8}$ inch and the distance from each side of the brace plate to the outer edge of the kneeboard support is $1\frac{1}{2}$ inches. Each riser form mounting hole is $\frac{5}{8}$ from a respective side of the kneeboard support. The overall length of the kneeboard support from the rearmost portion to the frontmost portion is $6\frac{7}{8}$ inches. The thickness of the kneeboard support is $\frac{3}{8}$ inch.

The distance from the bottom of the kneeboard support to the bottom edge 40 is 3 inches. The thickness of the riser support board 26 is $\frac{3}{8}$ inch and the riser support board extends downwardly at an angle of 6° from the vertical. The width of the riser support board is $3\frac{1}{8}$ inches. The perpendicular distance from the riser form mounting holes 52 in the riser support board to the adjacent edges is each $\frac{1}{2}$ inch. The distance the ledge 54 extends beyond the ends of the riser support board is $\frac{1}{8}$ inch on each side. The thickness of the brace plate is $\frac{3}{8}$ inch.

In an alternative embodiment, a support flange may extend immediately below each side of the kneeboard support and mounted to the respective side of the brace plate for supporting the kneeboard support. Each support flange would extend from the rearmost portion of the kneeboard support to the riser support board 26.

In assembling the form, a stringer 58 (FIGS. 4 and 5) to which a plurality of braces are to be mounted, one for each step to be formed, is placed on a flat surface. The flat surface may be the ground, a wall against which the stairs are to be formed or a frame defining one side of the stairs to be formed. If the rise and run, or the slope, of the stairs is easily determined, the stringer may be mounted to the wall prior to fixing the braces on the stringer. However, it is as easy, if not more so, to assemble a stringer and its corresponding braces prior to mounting the stringer on the wall or frame. It will be assumed hereafter that the stairs are to be formed between two vertical walls defining a transition between two floors.

Figure 4:
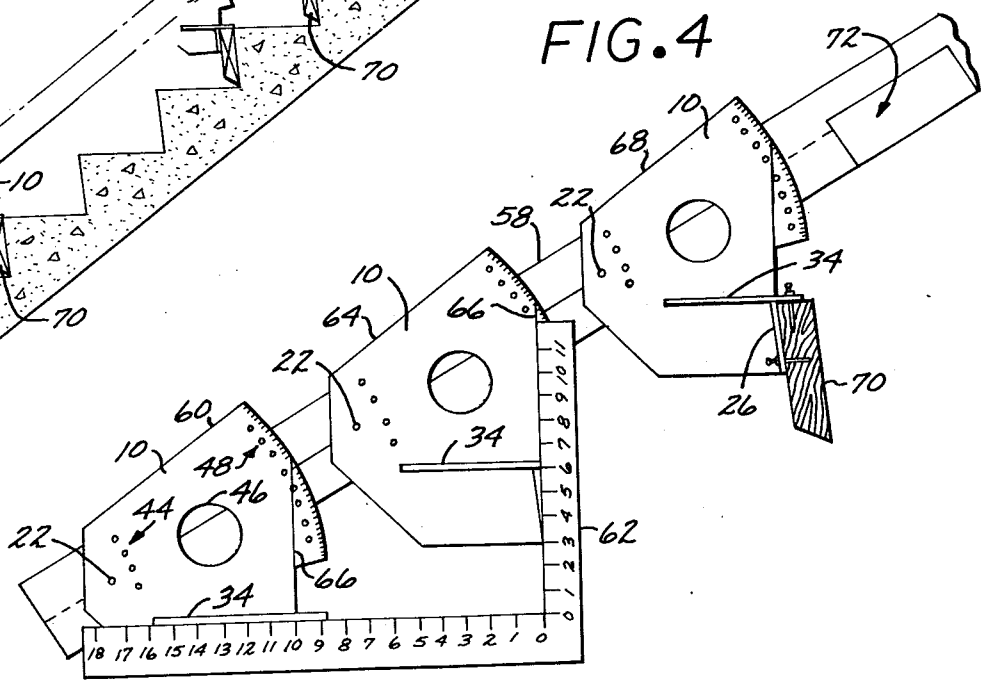
FIG. 4 is a side elevation view of several braces on a stringer.

If the left stringer is laid on the ground, a line is struck along the length of the string between the two sides of the stringer. (Left is taken to be the left side of the stairs when going up the stairs.) If the stringer is a 2×4, the line is struck $1\frac{3}{4}$ inches from each side. A first brace 60 is pivotally mounted through a nail placed through the pivot hole 22 for pivotally fastening the brace to the stringer. The nail preferably fastens the brace to the stringer so that the nail is on the line struck on the stringer. As indicated above, the preferred embodiment places the pivot hole $1\frac{3}{4}$ inches above the top surface of the kneeboard support. Therefore, the first brace may be pivotally mounted to the stringer by placing the kneeboard support of the second side of the brace against the bottom side of the stringer and placing the nail in the pivot hole. The nail will then intersect the chalk line. Once the nail is in place, the brace can be pivoted about the pivot hole 22 to a position such as that shown in FIG. 4. Since the kneeboard support portion on the second side of the brace plate would prevent movement in the opposite direction, the brace only pivots in a clockwise direction (as seen in FIG. 4) so that the kneeboard support placed against the bottom side of the stringer moves away from the stringer. The first brace is preferably placed a sufficient distance from the bottom end of the stringer to allow a stake to be fastened to the stringer.

A framing square 62 is placed against the bottom of that portion of the kneeboard support on the first side of the brace. The framing square is placed flush against the bottom of the kneeboard support and against the side of the riser support board so that the framing square fits underneath the ledge 54 in the first brace. A second brace 64 is then taken in hand and placed against the wide side of the stringer so that the pivot hole is positioned over the chalk line and so that the vertical portion of the framing square, as seen in FIG. 4, is flush with the outer side of that portion of the kneeboard support on the first side of the brace and so that the left edge of the vertical portion of the framing square is parallel to and slightly obscures the plumbline 66 on the second brace. The plumbline preferably extends perpendicular to the kneeboard. Assuming the desired run is 10 inches and the desired rise is 6 inches, the plumbline on the first brace is placed so as to intersect the 10-inch line on the horizontal portion of the framing square and the bottom of the kneeboard on a second brace is placed to intersect the 6-inch line on the vertical portion of the framing square 62. Since the vertical portion of the framing square is already held on the plumbline of the second brace, the only positioning that need be done at this point is to pivot the first brace about its pivot point 22. The second brace is positioned so that the pivot point of the second brace intersects the chalk line. If a chalk line is not used, the pivot hole is fixed once the rise and run for the first and second braces are set. The second brace can then be fixed by passing a nail through the pivot hole 22 of the second brace into the stringer. If the relative position of the scales on the first or second brace is also noted, with respect to the chalk line or either edge of the stringer, the first brace can then be immovably fixed to the stringer by passing additional nails through the mounting holes 44 or 48. Otherwise, the framing square can be used again to determine the correct pivotal position of either of the two braces with respect to the chalk line on the stringer. Either of the first or second braces may then be fixed. Then, the other braces can also be fixed by matching the position on the scale with respect to the chalk line or the edge of the stringer with that of the previously fixed brace. With the proper rise and run, the positions on the scales of the first and second braces should match relative to the chalk line.

If the kneeboard support is omitted from the brace, a line is formed or marked on the sides of the brace where the kneeboard support would be and perpendicular to the plumbline 66. To set the first two braces, the first brace is mounted as before and the horizontal portion of the framing square is aligned with the marked line. The first and second braces are then adjusted as before to set the pivot point of the second brace on the stringer. Omission of the kneeboard support requires somewhat more effort in assembling the form but the benefits of the brace in assembling the form are otherwise the same. However, the vertical support for the riser form is absent so that the weight of the cement against the riser form may cause the riser form to move relative to the riser form support board.

It is now a simple matter to mount the remaining braces on the stringer. All that need be done is to measure the distance between the pivot holes on the first and second braces 60 and 64, respectively, and position the third brace 68 so that the pivot hole 22 on the third brace is an equal distance along the chalk line from the pivot hole 22 on the second brace. Once the pivot hole is fixed, the pivotal location of the third brace can be fixed with respect to the stringer by positioning the appropriate notch on the scale with respect to the chalk line in a manner identical to the position of the first and second braces. Subsequent braces may then be placed in an identical fashion.

The corresponding stringer for the opposite wall is assembled in an identical manner. The stringer is placed on a flat surface. A line is struck down the middle of the stringer. The first brace is pivotally mounted. However, the first side rather than the second of the brace is placed flush against the side of the stringer. The brace is then allowed to rotate counterclockwise so that the kneeboard support moves away from the stringer. The framing square is used to mount the second brace to the stringer in a fashion identical to that described above. Subsequent braces are added in an identical fashion. Once the two stringer assemblies are formed, the stringers are mounted on their respective walls so that the first brace on one stringer is directly opposite the first brace on the corresponding stringer. The first stringer is mounted to the wall using a level placed on one of the kneeboard support so that the correct slope is provided. The second stringer is then mounted by placing a kneeboard and a level between a pair of braces and nailing the second stringer to ensure that the kneeboard is level. The plumblines on all of the braces are vertical. In other words, the kneeboards on all the braces will be horizontal. The stringers can be nailed to the wall either at points between the braces or through the large hole of several of the braces.

When the stringer assemblies are properly mounted, riser forms 70 may be mounted to corresponding pairs of braces. As shown in FIG. 4, a riser form is mounted to the third brace by passing nails through the holes in those portions of the kneeboard support and the riser support board on the first side of the brace. Nails are also used to mount the opposite end of the riser form to those portions of the kneeboard support and riser support board on the second side of the corresponding brace. These fastening means are sufficient to retain the cement and prevent rotation of the riser form when the cement backs up above the riser form. The riser form can be mounted to the respective braces by a single person. No additional help is necessary. The riser forms for the remaining pairs of braces may then be mounted in a similar manner. Once the entire form for the concrete stairs is assembled, the concrete can be poured as would be known by one skilled in the art.

Figure 5:
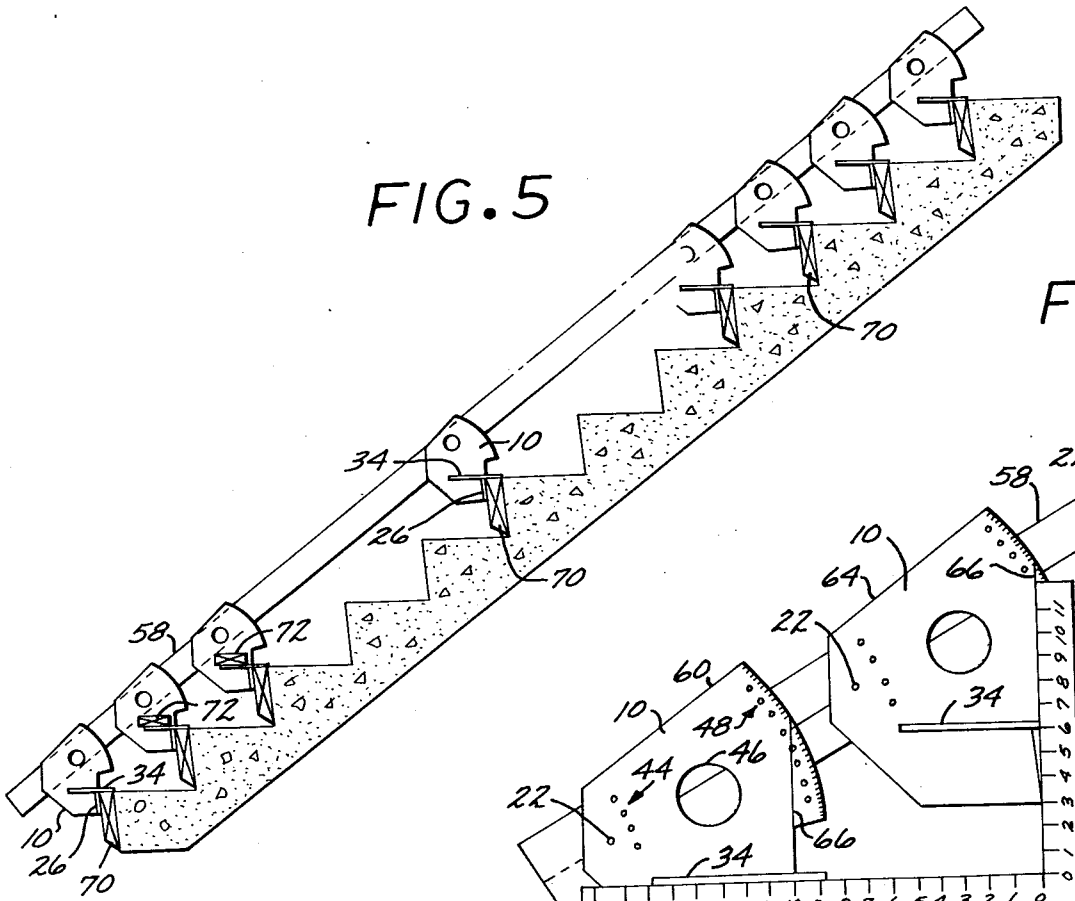
FIG. 5 is a partial side section and side elevation view of a concrete form showing a plurality of braces and riser forms mounted to a stringer.

Kneeboards 72 in the form of 2×4s or 2×6s can be placed between the pairs of braces with respective ends resting on respective kneeboard supports on the pair of braces. Only two kneeboards are shown in FIG. 5 but it is to be understood that a kneeboard can be placed between each pair of braces, over the location where each step is to be formed. These boards may be used to walk up and down the form for pouring concrete or for moving the concrete while it is still wet. These boards may also be used when troweling the tread of each step and to otherwise finish the stairs. Once the concrete has set, the form may be dismantled or broken down from top to bottom or bottom to top, as desired. The worker need only stand on one kneeboard and remove the next adjacent board, the braces on which the board rests and the riser form corresponding to the two braces. This may be repeated for each subsequent brace, riser form and board combination until the end of the stairs is reached. The stringers may then be removed as desired.

When the form is being dismantled, the first pair of braces and the first riser form is loosened from the stringers. The braces are removed and the first riser form is passed upward between each stringer and over the step formed by the riser. When the riser form is clear of the stringers, it can be lifted away from the form and stored. Subsequent riser forms are removed in a similar manner. However, with a long flight of stairs, a point will be reached where the worker cannot stand on the highest kneeboard and slip the riser form to the tops of the stringers. Therefore, a pocket 74 (FIG. 4) is formed in the lower part of each stringer every five feet or so. The riser form 70 can be removed by pivoting the riser form about a longitudinal axis so that the end of the riser form fits into the pocket on each stringer. One end of the stringer is lifted away from the stairs to remove the riser form. The remaining riser forms may then be removed through the pockets in a similar manner.

The braces may be formed from plastic by injection molding with holes preformed in the braces and the scaling already created along the arcuate side. With injection molding, the large hole saves material. The corners of the brace may be more rounded than those shown in FIGS. 1–3 as long as proper structural support is provided for the riser form and kneeboard. The braces may also be made from metal such as aluminum or from plywood, where the brace plate, the kneeboard support and the riser support board are bonded by glue or other adhesive. The pivot hole, mounting holes and the large hole may then be drilled in the brace plate. The pivot end 16 may be substantially vertical, as seen in FIGS. 1–3. The plumbline and the scales may be formed as desired, for example by painting.

The braces are simple and straightforward to use. The only hardware necessary to build the forms includes duplex nails, a framing square, a hammer, riser forms and a frame or stringers. The braces are dimensioned to meet the standard requirements of current building codes and of design architects. The placement of the pivot point in the preferred design is such that the pivot point is mounted to the middle of a 2×4 stringer when the upper surface of the kneeboard support is placed flush against the lower portion of the stringer. Additionally, placement of the pivot point as described above allows for construction of steps having rises of between 4 inches and 8 inches.

The riser support board is preferably permanently slanted as described above to provide a fixed toe-in or kickback. The riser support board may be used to support "form liners" for providing various riser designs.

The kneeboard support serves to make the brace interchangeable for use on the left or right side stringer. The kneeboard extends on both sides of the brace plate to serve this function. Additionally, where the kneeboard support extends on each side of the brace plate a distance of 1½ inches, and where a 2×4 is used for a stringer, the portion of the kneeboard support extending under the stringer serves as a brace against the frame or wall to prevent rocking or pivoting of the brace away from the stringer. As a result, each brace is supported from the side by the stringer and by the portion of the kneeboard support adjacent the wall or frame. Without the kneeboard supports, the riser support board serves as support for the brace plate against the wall or frame. The kneeboard supports also provide a support for boards extending between corresponding braces so that workers need not step on the riser forms to pour the concrete or to go up and down the form. Additionally, the extension of the kneeoboard beyond the vertical front side keeps the riser form from moving up or rotating due to the force of the concrete.

Furthermore, it is not necessary to mark or lay out the stringers as before. The placement of the braces is self-adjusting once the first two braces are positioned and the distance between adjacent pivot points is known and once the relative scale position of one brace with respect to a point on the stringer is known. A framing square is not necessary for subsequent braces. The pivot point on the brace will be the same for all layouts, and only the spacing between braces and the angle of the stringer will be different for different stairs. Additionally, the pivot point for braces used on a left stringer is the same as the pivot point used for braces on the right stringer. The savings in time for constructing the form is proportional to the number of steps which have to be created in the form. There is no need for any additional measurement or marking of plumblines or kickback lines, etc. The layout of the braces is thereafter automatic. The pivot point is preferably centered in the angle between the upper and lower scales. The pivot point serves to hold the braces in both the vertical and horizontal directions.

If the form is to be made without the benefit of the blue prints, the stringers may be mounted to the walls or frame according to the desired slope but without the braces. Then for a given number of braces or steps, the rise will be determined and only the run needs to be calculated. Once this is done, the braces for each stringer are mounted.

It should be noted that the above are preferred configurations, but others are foreseeable. The described embodiments of the invention are only considered to be preferred and illustrative of the inventive concepts. The scope of the invention is not to be restricted to such embodiments. Various and numerous other arrangements may be devised by one skilled in the art without departing from the spirit and scope of the invention.

What is claimed is:

1. An apparatus for making concrete forms for making stairs, the apparatus comprising:

a substantially planar member having a riser end and a pivot end substantially opposite the riser end and having first and second sides;

means for rotatably fixing the pivot end to a stringer so that the riser end can pivot with respect to the pivot end;

means adjacent the riser end for mounting the planar member to the stringer such that rotatably fixing the pivot end to the stringer and mounting the planar member to the stringer through the mounting means adjacent the riser end substantially fixes the planar member to the stringer;

a substantially planar riser support member defining a first plane perpendicular to the planar member, said riser support member being adjacent the riser end and comprising first and second sides extending to respective sides of the planar member a distance sufficient to allow support of a riser form by either by the first and second sides; and a flange member extending perpendicularly from the first and second sides of the planar member and defining a second plane intersecting with said first plane such that that riser support member is on a side of the flange member opposite the means for mounting the planar member to the stringer.

2. The apparatus as claimed in claim 1 wherein the planar member comprises a scale on the riser end for adjusting a pivotal position of the apparatus.

3. The apparatus as claimed in claim 1 wherein the mounting means comprises a plurality of holes.

4. The apparatus as claimed in claim 2 wherein the scale is on the first and second sides.

5. The apparatus as claimed in claim 2 wherein the riser support member is on a lower portion of the planar member and the scale is on an upper portion of the planar member.

6. The apparatus as claimed in claim 1 further comprising a plumbline on the first and second sides along at least a portion of the riser end.

7. The apparatus as claimed in claim 6 wherein the plumbline is non-parallel with respect to the riser support member.

8. The apparatus as claimed in claim 1 wherein the flange member defines a line non-parallel to the riser support member for use in positioning the planar member relative to the stringer.

9. The apparatus as claimed in 8 wherein the line defining means comprises means extending along the first and second sides of the planar member.

10. The apparatus as claimed in claim 9 wherein the flange member intersects the riser support member.

11. The apparatus as claimed in claim 10 wherein the flange member comprises a kneeboard support.

12. The apparatus as claimed in claim 10 wherein the rotatably fixed means comprises rotatably fixing means formed in the planar member at a first level and wherein the flange member is at a second level below the first level.

13. The apparatus as claimed in claim 10 further comprising a plumbline along at least a portion of the riser end and wherein the flange member extends on two sides of the plumbline.

14. The apparatus as claimed in claim 1 further comprising a viewing apparatus in the planar member for viewing a line on the stringer.

15. The apparatus as claimed in claim 1 wherein the apparatus is a one-piece device.

16. An apparatus for making concrete forms for making stairs, the apparatus comprising:

a substantially planar member having a riser end and a pivot end substantially opposite the riser end and having first and second sides;

means for rotatably fixing the pivot end to a stringer so that the riser end can pivot with respect to the pivot end;

a riser support member perpendicular to the planar member adjacent the riser end and extending to each side of the planar member;

a plumbline on the first and second sides along at least a portion of the riser end non-parallel with respect to the riser support member; and means defning a line perpendicular to the plumbline and extending along the first and second sides of the planar member, wherein the line defining means comprises a kneeboard support flange member extending from the first and second sides intersecting the riser support member and wherein the kneeboard support comprises means defining a pair of holes.

17. An apparatus for making concrete forms for making stairs, the apparatus comprising:

a substantially planar member having a riser end and a pivot end substantially opposite the riser end and having first and second sides;

means for rotatably fixing the pivot end to a stringer so that the riser end can pivot with respect to the pivot end;

a riser support member perpendicular to the planar member adjacent the riser end and extending to each side of the planar member;

a plumbline on the first and second sides along at least a portion of the riser end non-parallel with respect to the riser support member;

means defining a line perpendicular to the plumbline and extending along the first and second sides of the planar member, wherein the line defining means comprises a flange member extending from the first and second sides intersecting the riser support member, wherein the flange member extends on two sides of the plumbline; and means defining a pair of holes in the flange member on a side of the plumbline opposite the rotatably fixing means.

18. An apparatus for making concrete forms for making stairs, the apparatus comprising:

a substantially planar member having a riser end and a pivot end substantially opposite the riser end and having first and second sides;

means for rotatably fixing the pivot end to a stringer so that the riser end can pivot with respect to the pivot end;

a riser support member perpendicular to the planar member adjacent the riser end and extending to each side of the planar member;

a plumbline on the first and second sides along at least a portion of the riser end;

means defining a line perpendicular to the plumbline and comprising means extending along the first and second sides of the planar member, wherein the line defining means comprises a flange member extending from the first and second sides and intersecting the riser support member, and wherein the flange member comprises means defining holes extending along parallel lines which intersect the riser support member.

19. An apparatus for making concrete forms for making stairs, the apparatus comprising:

a first member substantially defining a first plane comprising means for pivotally supporting the first member at a point on a line on a stringer and a scale for pivotally aligning the first planar member with respect to the line;

a second member substantially defining a second plane substantially perpendicular to the first plane and extending approximately equidistant on first and second sides of the first member and extending at least partly in a direction along a line defined by the pivotally supporting means and a portion of the scale; and a third member substantially defining a third plane substantially perpendicular to the first plane and intersecting with the second plane for supporting a riser form wherein the third member is positioned such that the third member is on a side of the second member opposite the means for pivotally supporting the first member and the scale.

20. The apparatus as claimed in claim 19 wherein the pivotally supporting means comprises a wall defining a hole through the first member from the first to the second side.

21. The apparatus as claimed in claim 19 wherein the first member comprises a line formed on the first member extending in a direction substantially normal to the second member.

22. The apparatus as claimed in claim 19 wherein the second member comprises at least one wall defining a hole to which a top of a riser form may be fastened.

23. The apparatus as claimed in claim 19 wherein the second member comprises a kneeboard support.

24. The apparatus as claimed in claim 19 wherein the third member comprises at least one wall defining a hole through which a riser form may be fastened.

25. The apparatus as claimed in claim 19 wherein the third member extends on the first and second sides of the first member.

26. The apparatus as claimed in claim 19 wherein the second and third members intersect.

27. An apparatus for making concrete forms for making stairs, the apparatus comprising:

a first member substantially defining a first plane comprising means for pivotally supporting the first member at a point on a line on a stringer and a scale for pivotally aligning the first planar member with respect to the line;

a second member substantially defining a second plane substantially perpendicular to the first plane and extending approximately equidistant on first and second sides of the first member and extending at least partly in a direction along a line defined by the pivotally supporting means and a portion of the scale;

a third member substantially defining a third plane substantially perpendicular to the first plane for supporting a riser form; and wherein the second and third members intersect at an angle of less than 90°.

28. An apparatus for making concrete forms for making stairs, the apparatus comprising:

a substantially planar member having a riser end and a pivot end substantially opposite the riser end and having first and second sides;

means for rotatably fixing the pivot end to a stringer so that the riser end can pivot with respect to the pivot end;

means adjacent the riser end for mounting the planar member to the stringer such that rotatably fixing the pivot end to the stringer and mounting the planar member to the stringer through the mounting means adjacent the riser end substantially fixes the planar member to the stringer;

a substantially planar riser support member perpendicular to the planar member adjacent the riser end and comprising first and second sides extending to respective sides of the planar member a distance sufficient to allow support of a riser form by either of the first and second sides; and means defining a line non-parallel to the riser support member for use in positioning the planar member relative to the stringer wherein the line defining means comprises means extending along the first and second sides of the planar member and comprises a flange member extending from the first and second sides and intersecting the riser support member wherein the flange member extends a distance from a respective side of the planar member greater than the distance the corresponding side of the riser support member extends from the planar member to thereby form a ledge extending past the riser support member for accepting an edge of a framing square.

29. An apparatus for making stairs, the apparatus comprising:

a substantially planar member having a riser end, a pivot end substantially opposite the riser end and having first and second sides;

means defining an aperture for rotatably fixing the pivot end to a stringer so that a riser end can pivot with respect to the pivot end;

means adjacent the riser end for preventing rotation of the substantially planar member when fixed to a stringer along with fixing of the pivot end, said means adjacent the riser end comprising a lowermost end;

a substantially planar riser support member perpendicular to the planar member adjacent the riser end and below a line defined by the aperture and the lower-most end and comprising first and second sides extending to respective sides of the planar member a distance to allow support of a riser form by either by the first and second sides;

a flange member extending from the first and second sides and intersecting the riser support member wherein the flange member defines a plane and the riser support member and the means for preventing rotation are substantially located on opposite sides of the plane.

* * * * *